United States Patent [19]

Jones

[11] Patent Number: 4,551,591

[45] Date of Patent: Nov. 5, 1985

[54] STOP MOTION SWITCH

[76] Inventor: Robert E. Jones, Rte. 4, Box 509, Hickory, N.C. 28601

[21] Appl. No.: 621,841

[22] Filed: Jun. 18, 1984

[51] Int. Cl.[4] ..... B65H 25/14; D04B 35/12; F26B 13/12

[52] U.S. Cl. ..... 200/61.13; 28/187; 66/163; 200/61.18

[58] Field of Search ..... 200/61.13, 61.14, 61.18; 28/187; 66/157, 163, 166

[56] References Cited

U.S. PATENT DOCUMENTS

| | | | |
|---|---|---|---|
| Re. 19,069 | 2/1934 | Wachsman | 200/61.13 |
| 1,423,398 | 7/1922 | Connell et al. | 200/61.18 X |
| 1,721,291 | 7/1929 | Beachen | 200/61.18 |
| 1,784,560 | 12/1930 | Wachsman | 66/163 |
| 2,144,670 | 1/1939 | Wachsman | 200/61.13 |
| 2,242,875 | 5/1941 | Wachsman | 200/61.14 |
| 2,248,315 | 7/1941 | Wachsman | 200/61.14 |
| 2,689,393 | 9/1954 | Duryee | 28/187 |
| 2,733,308 | 1/1956 | Vossen | 200/61.13 |
| 2,744,174 | 5/1956 | Martin et al. | 200/61.18 |
| 2,801,307 | 7/1957 | Warwick | 200/61.18 |
| 2,825,119 | 3/1958 | Heffelfinger et al. | 28/187 |
| 2,963,890 | 12/1960 | Hoots | 28/187 X |
| 3,521,265 | 7/1970 | Bancroft | 200/61.14 X |
| 3,806,677 | 4/1974 | Deniega et al. | 200/61.13 |
| 4,075,445 | 2/1978 | Kempf | 200/61.18 |

*Primary Examiner*—J. R. Scott

*Attorney, Agent, or Firm*—Roy B. Moffitt

[57] ABSTRACT

A stop motion switch adapted to be in threaded engagement with an elongated filament and responsive to a break in the filament to cause the switch to go from a "first" to a "second" position (off to an on position) composed of a dielectric body and a rocker arm, the rocker arm being composed of two terminal portions, joined together by a median portion and a filament guide on at least one of the terminal portions, the longitudinal axis of the terminal portions being essentially perpendicular to the longitudinal axis of the median portion. The dielectric block contains an aperture, in which the median portion is rotatably received, a first terminal means in electrical communication with the median portion, a second terminal adapted to be connected to ground and an elongated electrical current carrying member disposed along side the dielectric body in such a fashion that upon rotation of the rocker arm the elongated electric current carrying member is adapted to come in sliding electrical and mechanical contact with one of the terminal portions of the rocker arm (on position) to complete a circuit that de-energizes a knitting machine and filament feeding machine, the sliding motion being such that the final electrical and mechanical contact of the elongated electrical current carrying with the terminal portion of the rocker arm is different from its initial contact.

5 Claims, 11 Drawing Figures

STOP MOTION SWITCH

FIELD OF THE INVENTION

The present invention is a stop motion switch for monitoring the continuity of an elongated filament such as a thread or yarn continuously applied to a textile machine, e.g., a knitting machine.

BACKGROUND OF THE INVENTION

Stop motion switches of various known constructions are used to monitor the continuity of elongated filaments, a thread or yarn as such thread or yarn is continuously supplied to a textile machine, e.g., a knitting machine. Examples of such known constuctions are disclosed in the following U.S. Pat. Nos. 4,075,445; 3,521,265; 2,963,890; 2,825,119; 2,801,307; 2,689,393; 1,784,560; 1,721,291; and 1,423,398. U.S. Pat. No. 1,721,292 is a typical example of the prior art type switch construction and comprises a contact plate adapted to come in contact with a bus bar to complete an electrical circuit. The contact plate is held out of contact with the bus bar by a filament threaded through an eyelet forming a part of the contact and upon breakage of the filament the contact comes in contact with the bus bar closing a circuit and thus de-energizes a textile machine to which the filament was being fed. Here, as in other prior art switches, which perform the same function, the electrical and mechanical engagement between the contact and bus bar is always in essentially the same confined area.

Any textile environment is almost always subject to dust particles and oil having the inherent tendency to accumulate on the very area where electrical contact is made in stop motion switches. It takes only a minor accumulation of dust, oil or a mixture of the two in this vital area to cause a short, thus causing a failure of the switch to perform its intended function, i.e., de-energize a knitting machine when a break in the continuity of the filament being fed into the textile machine occurs. It is towards the solution of this problem that this invention is directed.

SUMMARY OF THE INVENTION

The hereinafter disclosed switch is a switch adapted to be in threaded engagement with an elongated filament and responsive to a break in its continuity to cause the switch to go from a first to a second position. The first position could be one in which the switch was opened (off) and the second position could be one in which it was closed (on). When the switch is closed, a condition is rendered in a well known manner such that power to a textile machine is discontinued simultaneously with the feeding of filament to the textile machine.

The disclosed switch is composed basically of a rocker arm and dielectric body. First, median and second elongated members made of material adapted to conduct electricity comprise the rocker arm, the first and second elongated members being terminal portions connected together by the median member. One terminal end portion of at least one of this first and second elongated members contains a filament guide means through which the elongated filament sought to be fed into a textile machine is threaded.

The dielectric block contains an aperture into which the median member of the rocker arm is rotatably received. It also has a first terminal means in electrical communication with the median member, a second terminal means adapted to be in electrical communication with ground and an elongated means, adapted to conduct electricity, connected to the second terminal means and disposed along side the dielectric body in such a fashion that upon rotation of the rocker arm it comes in sliding electrical and mechanical contact therewith. Specifically, this member is disposed relative to the second elongated member of the rocker in such a fashion that the second elongated member of the rocker comes in initial mechanical contact with the elongated member and slides along the longitudinal axis thereof to a position different from that of its initial contact position, when there is a break in the continuity of the filament threaded through the filament guide means.

DETAILED DESCRIPTION OF THE INVENTION

Figure 1:
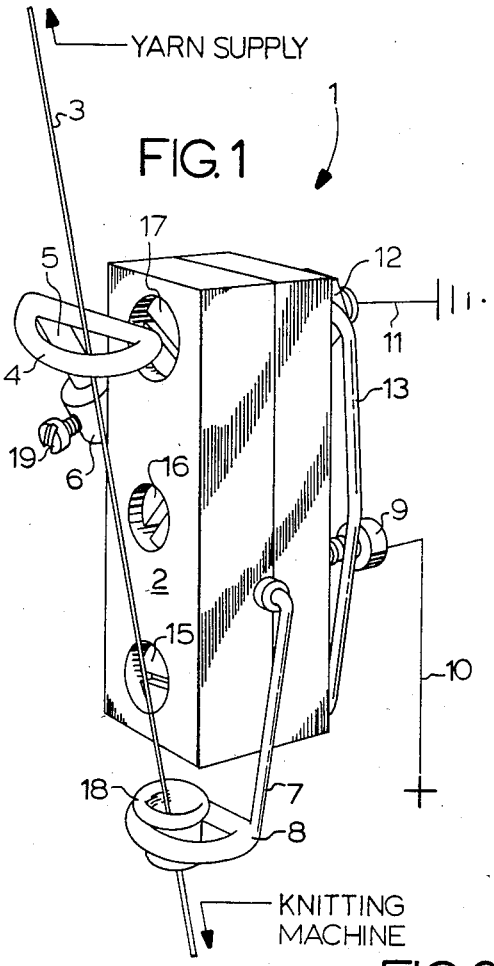
FIG. 1 is a prospective view of a first embodiment of the disclosed invention in its operating position with an unbroken filament.

Shown in FIG. 1 by element 1 is a first embodiment of the stop motion switch of the instant invention. Element 1 is composed of a dielectric body 2 and a rocker arm, the rocker arm being composed of eyelets 4 and 8, elongated members 5 and 7 and a median element 38, all integral with one another. Disposed in one or more of the eyelets 8 and 4 is a ceramic guide means 18. Filament 3 is threaded through eyelet 4 and 8 through ceramic guide means 18 and thereafter fed into a knitting machine in a well known fashion. The position of filament 3 relative to eyelets 4, 8 and 18 determines the juxtaposition of the rocker arm relative to the dielectric body and element 13. Element 5 contains a weight means 6 coaxially received thereon which can be adjusted using screw means to fix weight 6 at any desired position along the longitudinal axis of element 5.

Dielectric block 2 contains an aperture in which a metallic sleeve 14 is disposed, inside of which element 38 of the rocker arm is rotatably nested. Element 38 20 is not only in mechanical but also electrical contact with metallic sleeve 14. Apart from ceramic eyelet 18, the other elements of the rocker arm, namely, eyelets 4 and 18, elements 5, 38 and 7 are all made of material that is adapted to conduct electrical current. Terminal means 9 comes in contact both mechanically and electrically with sleeve 14 at point 23. Nut and bolt 17 and 12 are connected to an electrical current carrying means 13 disposed along side dielectric block 2 in such a fashion that upon rotation of the rocker arm element 7 is adapted to come in sliding electrical and mechanical contact therewith.

Figure 2:
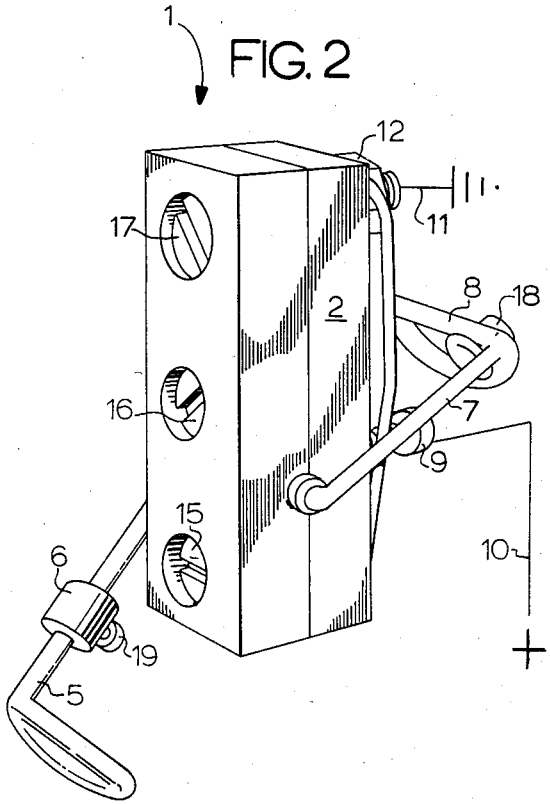
FIG. 2 is a similar prospective view of the embodiment of FIG. 1 showing the switch in its semi-closed position, broken filament.
Figure 3:
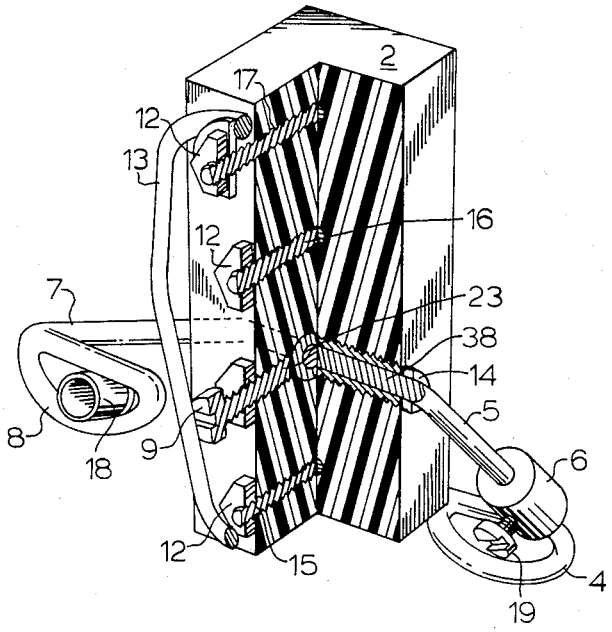
FIG. 3 is a partial cutaway prospective view of the reverse side of the switch of FIGS. 1 and 2, in its closed position.

Terminal 9 is connected by lead 10 to a potential source of electrical current (not shown) and screw 17 is connected by bolt 12 to lead 11 to ground. In operation, when filament 3 breaks, the rocker arm begins to rotate because of the weight 6; a partial, but not complete, rotation of the rocker arm is shown in FIG. 2. A complete rotation of the rocker arm is shown by FIG. 3 with element 7 being in contact with element 13. The manner by which element 7 comes in contact with element 13 is important to the operation of the instant stop motion switch.

Figure 4:
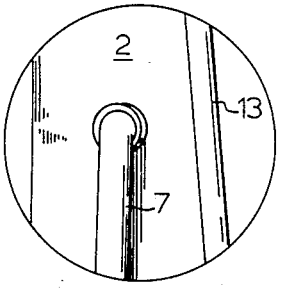
FIG. 4 is an exploded fragmentary view of arm 7 of FIG. 1 in its opened position.
Figure 5:
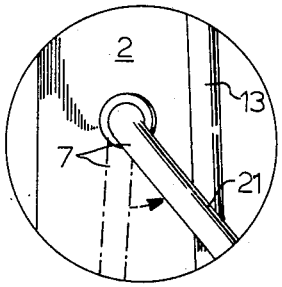
FIG. 5 is an exploded fragmentary view of arm 7 of FIG. 2 in a first position in contact with element 13.
Figure 6:
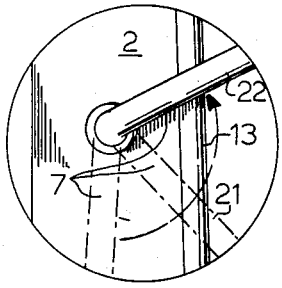
FIG. 6 is an exploded fragmentary view of arm 7 of FIG. 2 in a final mechanical and electrical contact with element 13.

FIGS. 4, 5 and 6 illustrate the various positions that element 7 goes through in electrical and mechanical contact with element 13. As long as filament 3 maintains its physical integrity (there are no breaks or separations), element 7 and 13 maintain their relative positions as shown by FIGS. 1 and 4. Once, however, there is a break in filament 3, the rocker arm rotates and element 7 goes from its first (dotted line) position as shown in FIG. 5 to an initial mechanical and electrical contact (solid line) with element 13 at position 21. Because of the position of element 13 relative to element 7, the contact continues, in a sliding fashion shown in FIGS. 5 and 6, until the final electrical and mechanical position, shown in exaggerated form in FIG. 6. In FIG. 6, the extreme left-hand dotted line representation of element 7, represents element 7 as it appears in FIG. 1. Counterclockwise, the next dotted line representation of element 7 is shown as it first contacts element 13, in position 21 and further counterclockwise, solid lines represent its final resting place at position 22.

Element 13 is an elongated electrical current carrying means, one end of which is in electrical and mechanical connection with screw 17 and the other end either is free or may be in engaging relationship with dielectric body 2 (not shown). In any event, element 13 is disposed, usually spaced apart from dielectric body 2 as shown in FIGS. 1, 2 and 3 (but not necessarily so), in such a fashion that the juxtaposition of elements 7 and 13 are such that upon rotation of the rocker arm, element 7 comes in sliding mechanical and electrical contact with element 13 in the manner described by FIGS. 4, 5 and 6.

Lead 10 is connected to an electrical potential and lead 11 is connected to ground. Both leads may be connected to a solenoid device that may be activated upon closing of switch 1, i.e., when the switch is in position as shown in FIGS. 3, 5 and 6. Upon the switch 1 closing, the solenoid device (not shown) is activated and it opens another switch thereby deactivating and de-energizing a feeding mechanism (not shown) of the knitting machine and the knitting machine itself (not shown).

It is that area from position 21 to position 22 along the longitudinal axis of element 13 that element 7 "wipes" as it comes into mechanical and electrical contact therewith. It is the sliding action of element 7 against element 13 between the initial and final contact position, positions 21 and 22, that removes oil, dust and lint accumulated thereon and improves the performance of the disclosed switch over prior art devices.

In the embodiment shown in FIGS. 1, 2 and 3, eyelets 4 and 8 are shown, one for each terminal portion of elongated member 5 and 7 respectively. Ceramic guide means 18 can be inserted in either one or more of the eyelets 4 and 8.

The closing of the aforementioned solenoid is caused by a completed electrical circuit, viz: from ground to solenoid (not shown) through positive potential, lead 10, element 9, element 14, element 38, element 7, element 13, element 12 lead 11 to ground. Element 17 is an ordinary screw means with its head countersunked in dielectric body 2. Elements 15 and 16 are screw means used to hold the two blocks (un-numbered) of dielectric body 2 together.

Figure 7:
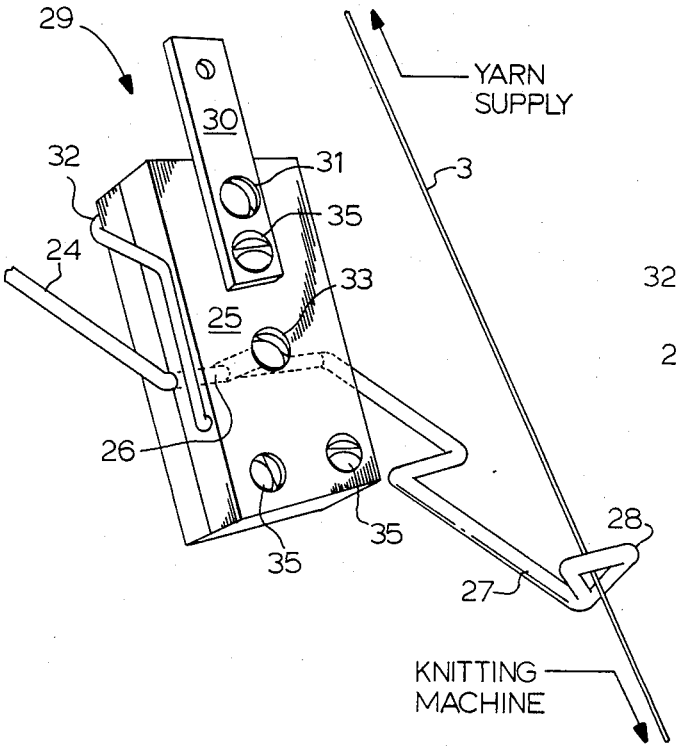
FIG. 7 is a perspective view of a second embodiment of the disclosed invention in its operating position with an unbroken filament.

FIGS. 7, 8, 9, 10 and 11 describe another embodiment of the instant invention. Referring to FIG. 7, stop motion switch 29 is composed primarily of a dielectric block 25 and a rocker arm composed primarily of first elongated member 24, median member 26 and second elongated member 27, all integral with one another and made of material that readily conducts electrical current. Dielectric block 25 is made up of two members (un-numbered) which are affixed together by screw means 31 and 35 and bolts 34. Screw means 31 and 35 and bolts 34 are used to affix mounting means 30 to dielectric block 25. Mounting means 30 is used in a manner (not shown) well known in the art to mount the stop motion switch 29 to any base or frame one desires.

The structure and operation of stop motion switch 29 is somewhat similar to that of the stop motion switch 1. Dielectric block 25 has an aperture therein in which element 26 is rotatably disposed. Screw means 33 (composed of current carrying material) has a hole therein through which element 26 is rotatably inserted. Along side electric block 25 is an elongated current carrying means 32, one end of which terminates at the surface of dielectric block 25 and another terminates and is in electrical and mechanical contact with screw means 31.

FIG. 7 shows switch 29 in its opened position with filament means 3 threaded through eyelet 28 holding the rocker arm (composed of elements 24, 26 and 27) in the position indicated, i.e., element 24 is spaced apart from elongated current carrying member 32. If filament 3 breaks, the weight of element 27 causes the rocker arm to go from the position shown in FIG. 7 to the position shown in FIG. 8. This type of switch finds adaptability in the knitting of rubber yarns or other heavy yarns.

Figure 8:
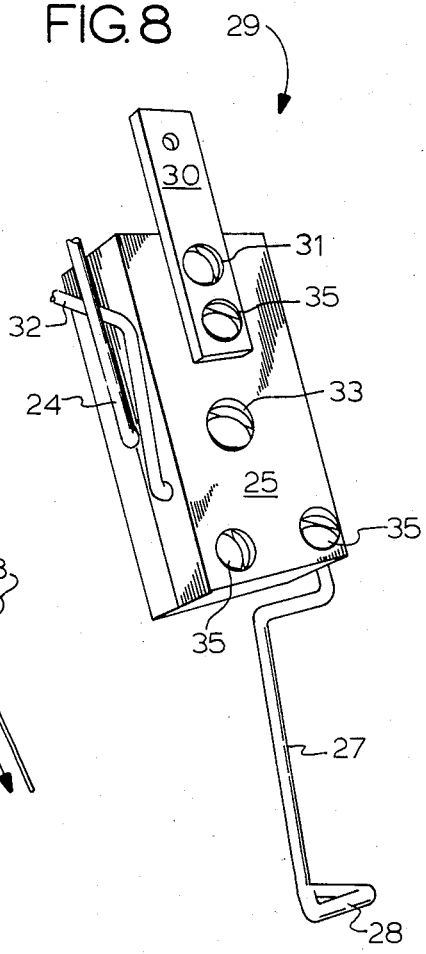
FIG. 8 is a similar prospective view of the embodiment of FIG. 7 showing the switch in its closed position, broken filament.
Figure 9:
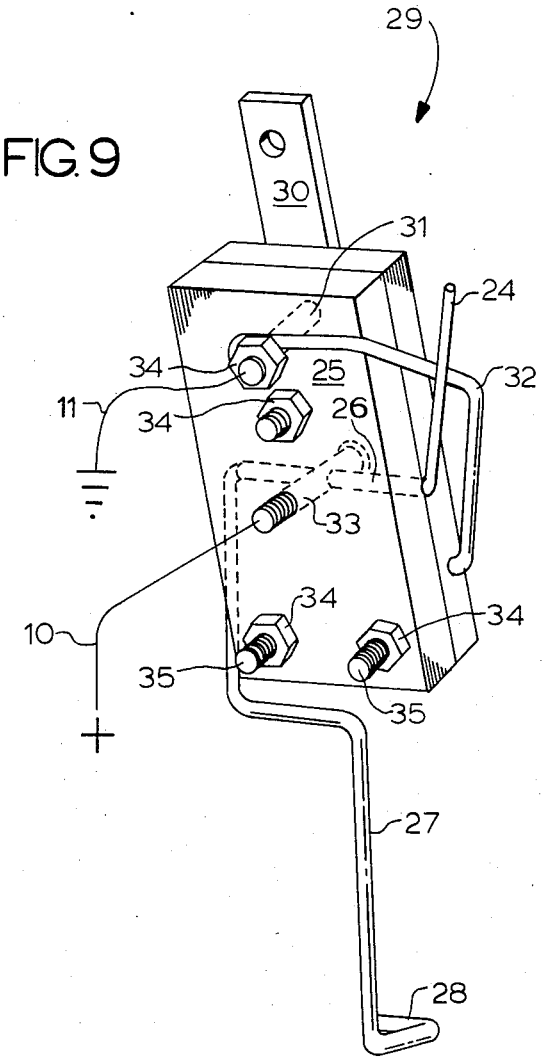
FIG. 9 is a prospective view of the reverse side of the switch shown in FIG. 8.

Once switch 29 is caused to go into the position shown in FIG. 8, an electrical circuit is completed in the same fashion as that described for the previous described embodiment (element 1) causing a solenoid (not shown) to activate and thereby de-energizing a feeding mechanism (not shown) feeding yarn into a knitting machine (not shown) and de-energizing a knitting machine simultaneously.

Figure 10:
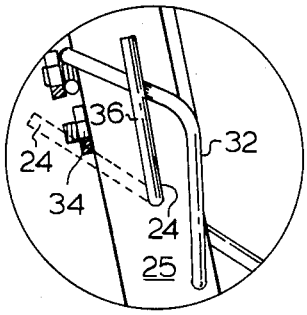
FIG. 10 is an exploded fragmentary view of contact arm 24 showing a transition from the opened position of FIG. 7 to an initial mechanical and electrical closed position.
Figure 11:
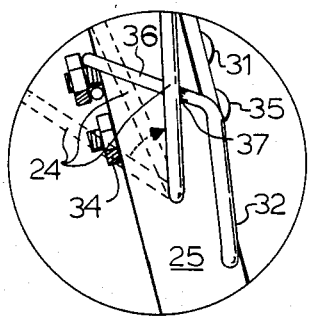
FIG. 11 is also an exploded fragmentary view of contact arm 24 showing a transition from the open position of FIG. 7 to an initial then final mechanical and electrical closed position.

When filament 3 breaks, (see FIGS. 10 and 11) element 24 comes into a sliding and mechanical contact with element 32. The first instance that element 24 makes such electrical and mechanical contact with element 32 is depicted by FIG. 10 (solid lines) at position 36. Shown on an exaggerated scale by FIG. 11, is the final position of element 37 in electrical and mechanical contact with element 32. Thus, as with the previously described embodiment, there is a area between position 36 and position 37 where element 24 slides along in electrical and mechanical contact with element 32. Once the initial electrical contact is made by element 24 with element 32, an electrical circuit is completed as follows: current flows through a potential (+) onto lead 10, to metallic screw 33, to element 26, to element 24, to element 32, to element 31, down lead 11 to ground, through a solenoid (not shown) which causes a switch to open (not shown) and de-energizes both a feeding mechanism and the knitting machine simultaneously, neither the feeding mechanism or the knitting machine being shown.

In both of the above described stop motion switch embodiments, there is an area of sliding electrical and mechanical contact when the switch goes from a first to a second position. In the case of the embodiment of FIGS. 1 through 6, the area between point 21 and point 22 is where element 7 comes in contact with element 13. With respect to the embodiment shown in FIGS. 7 through 11, the area is between point 36 and point 37. It is this wiping or sliding action of contact arm 7 with contact 13 and arm 24 with contact 32 that removes the dust, oil and/or lint particles that would otherwise accumulate and cause malfunction. Ceramic guide means such as that shown by element 18 in FIG. 1, the first described embodiment, can be disposed in eyelet 26 as desired and may be disposed in both eyelets 4 and 8 of the first described embodiment.

What is claimed is:

1. A switch adapted to be in engagement with an elongated filament and responsive to a break in said elongated filament to cause the switch to go from a "first" to a "second" position comprising:

(a) a rocker arm including first, median and second members made from material adapted to conduct electricity, one end portion of either of the first and second members containing a filament guide means; and, (b) a dielectric block containing (i) an aperture therein into which the median member portion of the rocker arm is rotatably received, (ii) a first terminal means in continuous electrical communication with the median member of the rocker arm, (iii) a second terminal means adapted to be in electrical communication with ground and, (iv) an elongated member adapted to conduct electricity connected to said second terminal means, a portion thereof spaced apart from the dielectric block in such a fashion that upon rotation of the rocker arm the second member comes in sliding electrical and mechanical contact with the elongated member by making an initial mechanical and electrical contact therewith at a first position and sliding along the longitudinal axis thereof to a second position different from that of the first.

2. The switch of claim 1 wherein the longitudinal axis of the first and second members of the rocker arm are essentially perpendicular to the longitudinal axis of the median member.

3. The switch as described in claim 2 wherein the first and second members of the rocker arm contain a filament guide means.

4. The switch as described in claim 1 including an electrically conductive sleeve member disposed in the aperture of the dielectric block, circumscribing and in electrical communication with at least a part of the median member of the rocker arm and the first terminal.

5. The switch as described in claim 1 wherein the first terminal is an elongated member with an aperture therein transverse to its longitudinal axis in which the median of the rocker arm is rotatably disposed.

* * * * *